US006083330A

United States Patent [19]

Moskowitz

[11] Patent Number: 6,083,330

[45] Date of Patent: Jul. 4, 2000

[54] PROCESS FOR FORMING A COATING ON A SUBSTRATE USING A STEPPED HEAT TREATMENT

[75] Inventor: Leonard Moskowitz, Cherry Hill, N.J.

[73] Assignee: The United States of America as represented by the Secretary of the Navy, Washington, D.C.

[21] Appl. No.: 09/162,458

[22] Filed: Sep. 16, 1998

[51] Int. Cl.[7] ..... C23C 4/00; C23C 4/06; C23C 4/18

[52] U.S. Cl. ..... 148/527; 427/456; 148/537

[58] Field of Search ..... 148/537, 527; 427/456

[56] References Cited

U.S. PATENT DOCUMENTS 5,087,305 2/1992 Chang ..... 148/410

5,137,422 8/1992 Price et al. ..... 415/200

*Primary Examiner*—George Wyszomierski

*Assistant Examiner*—Janelle Combs Morillo

*Attorney, Agent, or Firm*—Ron Billi

[57] ABSTRACT

The present invention is directed to a coating process for forming a high quality, high ductility, metallurgically bonded coating on a substrate or part. The process comprises applying a coating to the substrate using an HVOF spray coating technique and subjecting the coated substrate to a stepped heat treatment for diffusing the coating into the substrate while substantially avoiding the formation of macro cracks.

10 Claims, 1 Drawing Sheet

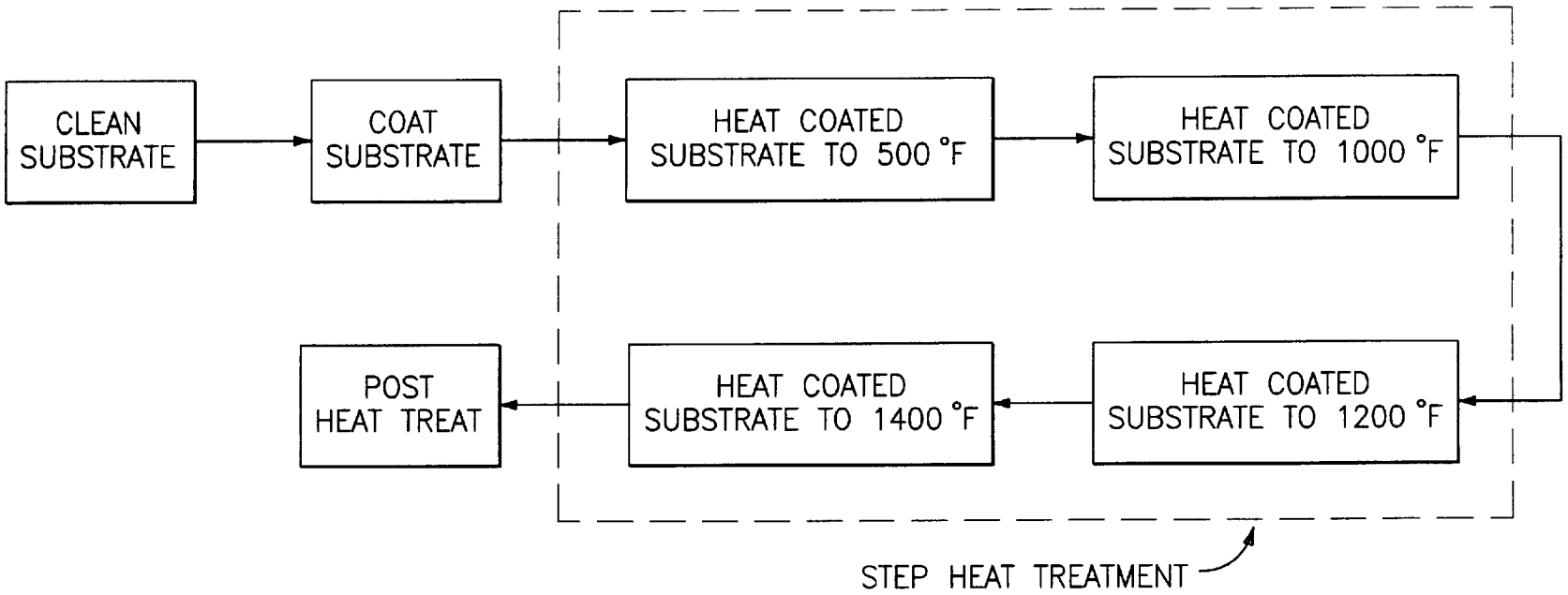
CLEAN SUBSTRATE
COAT SUBSTRATE
HEAT COATED SUBSTRATE TO 500 °F
HEAT COATED SUBSTRATE TO 1000 °F
HEAT COATED SUBSTRATE TO 1400 °F
HEAT COATED SUBSTRATE TO 1200 °F
POST HEAT TREAT
STEP HEAT TREATMENT

PROCESS FOR FORMING A COATING ON A SUBSTRATE USING A STEPPED HEAT TREATMENT

STATEMENT OF GOVERNMENT INTEREST

The invention described herein may be manufactured and used by or for the Government of the United States of America for governmental purposes without the payment of any royalty thereon or therefor.

BACKGROUND OF THE INVENTION (1) Field of the Invention

The present invention is related to a process for coating a workpiece and to form a coating which has a metallurgical bond, high ductility, and high density. The process of the present invention has particular application in applying spray and fuse material coatings to steel substrates used for landing hook points, then omitting the fusing operation.

(2) Prior Art

There are a number of methods currently being used to form coatings. For example, powder spray methods are currently being used to form coatings on a wide variety of articles. Spray and fuse coatings are more difficult to manufacture because of the high temperatures required. The high temperatures needed for the coating can cause damage in the base metal and the act of becoming liquid during these kinds of coating techniques can cause the coating to change shape. Coatings which are formed by techniques other than spray or fuse suffer from other deficiencies, most notably, the coatings do not have metallurgical bonds to the substrate. They also exhibit lower densities than High Velocity Oxygen Fuel (HVOF) coatings. HVOF coatings, in addition to not having metallurgical bonds, are harder and more brittle than other forms of coatings.

There remains a need for a coating process which yields a coating that exhibits a metallurgical bond, high ductility, and high density.

SUMMARY OF THE INVENTION

Accordingly, it is an object of the present invention to provide a coating process for forming a coating which has a metallurgical bond with the substrate, high ductility, and high density.

It is an object of the present invention to provide a coating process as above wherein the substrate and/or the coating are never heated to a temperature approaching the melting point of the coating.

The foregoing objects are attained by the coating process of the present invention.

In accordance with the present invention, a process for forming a coating on a substrate, which coating is metallurgically bonded to the substrate and has a high ductility and a high density comprises the steps of applying a coating to the substrate using an HVOF thermal spray coating technique, and subjecting the coated substrate to a stepped heat treatment for diffusing the coating into the substrate while avoiding the formation of any macro cracks. The stepped heat treatment comprises incrementally heating the coated substrate to avoid the formation of macro cracks while allowing the coating material to diffuse into the substrate so as to form a highly desirable metallurgical bond.

Other details of the present invention, as well as other objects and advantages attendant thereto, are set forth in the following detailed description and the accompanying drawings wherein like reference numerals are depicted therein.

BRIEF DESCRIPTION OF THE DRAWINGS

The FIGURE is a flow chart illustrating the coating process of the present invention.

DETAILED DESCRIPTION OF THE PREFERRED EMBODIMENT(S)

The coating process of the present invention is intended to produce a high quality thermal spray coating. The process broadly comprises forming a coating on a substrate, using an HVOF thermal spray process, and thereafter subjecting the coated part to a stepped heat treatment for diffusing the coating into the substrate and forming a strong metallurgical bond therebetween without any substantial macro cracks.

The substrates or parts which may be coated by the process of the present invention include those formed from steels, stainless steels, nickel alloys and superalloys. For example, the process of the present invention has particular utility in the coating of steel landing hook points.

The coating materials which are applied to the substrate may comprise any suitable coating material known in the art such as Inconel or spray and fuse coatings normally applied by gas or plasma and then fusing.

Prior to being subjected to any coating step, the substrate material may be cleaned to remove oxides and other deleterious materials and contaminants. The cleaning process which is implemented may comprise any suitable cleaning process known in the art. The cleaning process employed to clean the surfaces of the substrate to be coated does not form part of the present invention and therefore has not been described in detail.

After cleaning the substrate is coated with a suitable coating material known in the art. While any suitable coating technique known in the art may be used to apply the coating to the substrate, this process uses an HVOF thermal spray process. All thermal spray processes have three steps in common: (1) feeding the coating material; (2) heating the material; and (3) transferring the material to the part to be coated. In the process of the instant invention, the thermal spray coating may be applied using a commercial high velocity oxygen fuel (HVOF) gun such as the JetKote gun manufactured by Thermodyne, Inc., the CDS gun of the Sulzer Group, the TopGun of UTP, the Diamond Jet gun manufactured by Sulzer Metco, Inc. or the JP 5000 gun manufactured by TAFA.

In the JetKote gun, for example, oxygen and fuel gas are burned in a combustion chamber and the hot-gas is directed through a ring of ports to a barrel. The coating material in powder form is injected axially in the center of the ports, where it is heated and accelerated out the barrel with the combustion gases. Water cools both the combustion chamber and barrel. After ejection from the barrel, the coating material particles impact on the substrate material and thus, an initial coating is formed.

The JP-5000 gun is different from the JetKote gun and uses liquid fuel and a more thermally efficient aspiration powder injection. Oxygen at 2000 scfh and fuel, usually kerosene, are fed into a combustion chamber in the rear of the gun and ignited with a spark plug. The combustion gases pass through a nozzle and a barrel producing a long, small diameter flame with 8 to 12 shock diamonds. The coating material in powder form is radially injected through multiple ports, in an over expanded, sub-atmospheric pressure region after the internal nozzle throat, thus eliminating the need for a high pressure powder feed system. The resulting spray stream of coating material is very tight and can be sprayed a distance of 10.5 to 13.5 inches.

The thermal spray coating process should yield a coating which has a high density and which is relatively clean commensurate with known achievable quality.

To produce a high quality coating with substantially no macro cracks, the coated substrate or part is subjected to a stepped heat treatment which involves heating the coated part or substrate to a temperature of up to about 1400° F. over a time period of several hours, preferably at least three hours, and most preferably at least four hours. It has been found that such a treatment is particularly desirable where the initial coating, such as a HVOF coating, is prone to brittleness and is thermal shock sensitive. In carrying out the stepped heat treatment of the present invention, the coated substrate or part is slowly heated as opposed to charging cold into a furnace preset to a high heating temperature and heating in 60 minutes or less.

In one embodiment of the present invention, the stepped heat treatment involves subjecting the coated substrate or part to at least three heating steps. In a first step, the coated substrate or part is placed in a furnace which is no hotter than 500° F. The coated substrate or part is then heated to a temperature of about 500° F. over a time period no less than 30 minutes and thereafter held at temperature for about 30 minutes. The furnace which is used to carry out the various heating steps in the process of the present invention may be any suitable furnace known in the art.

In a second step, the furnace is set to a temperature of about 1000° F. The coated substrate or part is then heated to a temperature of about 1000° F. over a period of time which is preferably no less than 30 minutes and held at that temperature for about 30 minutes.

In a third step, the furnace is set to a temperature of about 1200° F. The coated substrate or part is then heated to a temperature of about 1200° F. over a time period of no less than 30 minutes and held at that temperature for a time period of about 30 minutes.

In a fourth step, which may be optional for some coated substrates or parts, the furnace is set to a temperature of about 1400° F. The coated substrate or part is then heated to a temperature of about 1400° F. over a time period of no less than 30 minutes and held at that temperature for a time period of about 30 minutes.

The heat treatment schedule outlined above is important because it has been found that heating rates up to 1400° F. must be controlled. As previously mentioned, some coatings such as HVOF coatings, as sprayed, tend to be brittle and thermal shock sensitive. It has been found that the coated substrates or parts of the present invention are best heated to their final temperature no more rapidly than four hours. It has also been found that the coatings of the present invention are not sensitive to cooling rate once they have been heated to the specified times and temperature.

The sprayed coatings may be subjected to a post heating treatment wherein the coated parts are heated to a minimum temperature of about 1400° F. to a maximum temperature slightly less than the melting point of the coating. This post heat treatment may be carried out for time periods in the range of from about 0.5 to 24 hours using any suitable furnace known in the art. Here it should be noted that the desired time and temperature for the post heating treatment will vary with coating chemistry and the desired quality.

While it is preferred to control heating rates as set forth hereinbefore, controlled heating rates are not necessary if the possibility of macro cracks in the coating is not significant.

Bond coupons per ASTM 633, sprayed to thicknesses greater than 0.030 inches, may be used to determine what combination of time and temperature is required to reach a desired bond strength. For example, spray and fuse powders Metco 12c will achieve a bond that fails in the epoxy-coating interface after 1500° F. for three hours. Coatings of Inconel will achieve this bond strength level after three hours at 1650° F.

Using the heat treatment technique of the present invention, spray and fuse coatings can approach fused status without having to heat to the melting point of the coating or go through standard fusing methods by heating to only 1500° F. Inconel coatings will achieve a metallurgical bond after heating to 1650° F. The ability to withstand impact compared to HVOF coatings is increased substantially with this technique. Further, the resultant coating has a high quality and a high ductility. Still further, it has been found that the resultant coating is metallurgically bonded to the substrate material. It is believed that this result is due to the enhanced diffusion created during the stepped heat treatment employed in the process of the present invention as a result of the cold work imparted to the surface as a result of the HVOF process.

It is apparent that there has been provided in accordance with this invention a coating process which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A process for forming a high quality, high ductility metallurgically bonded coating on a substrate comprising the steps of:

applying a coating to said substrate using a thermal spray coating technique;

subjecting said coating substrate to a stepped heat treatment for diffusing said coating into said substrate while substantially avoiding the formation of macro cracks;

said stepped heat treatment comprising slowly heating said coated substrate to a temperature of up to about 1400° F. in multiple steps; and said stepped heat treatment having a first stage comprising placing said coated substrate in a furnace at a temperature less than about 500° F., heating said coating substrate to a temperature of about 500° F. in a time no less than about 30 minutes, and holding said coated substrate at a temperature of about 500° F. for about 30 minutes.

2. The process of claim 1 wherein said stepped heat treatment has a second step which comprises:

heating said furnace to a temperature of about 1000° F.;

heating said coated substrate to a temperature of about 1000° F.; and holding said coated substrate at a temperature of about 1000° F. for about 30 minutes.

3. The process of claim 2 wherein said stepped heat treatment has a third step which comprises:

heating said furnace to a temperature of about 1200° F.;

heating said coated substrate to a temperature of about 1200° F.; and holding said coated substrate at a temperature of about 1200° F. for about 30 minutes.

4. The process of claim 3 wherein said stepped heat treatment has a fourth step which comprises:

heating said furnace to a temperature of about 1400° F.;

heating said coated substrate to a temperature of about 1400° F.; and holding said coated substrate at a temperature of about 1400° F. for about 30 minutes.

5. The process of claim 1 further comprising post heat treating said coated substrate by heating said coated substrate to a temperature in the range of about 1400° F.to the coating melting point for a time period in the range of from about 0.5 hours to about 24 hours.

6. The process of claim 1 further comprising providing a substrate selected from the group consisting of steels, stainless steels, nickel based alloys and superalloys.

7. The process of claim 5 wherein said coating applying step comprises applying a nickel based alloy coating to said substrate.

8. The process of claim 1 further comprising providing a stainless steel hook point as the substrate and said coating applying step comprising applying a nickel based alloy coating to said stainless steel hook point.

9. The process of claim 1 wherein said stepped heat treatment is carried out for no less than four hours.

10. The process of claim 1 wherein said step of applying a coating to the substrate comprises applying said coating using a high velocity oxygen fuel spray coating technique.

* * * * *